US008721061B2

(12) United States Patent
Govyadinov et al.

(10) Patent No.: US 8,721,061 B2
(45) Date of Patent: May 13, 2014

(54) FLUID EJECTION DEVICE WITH CIRCULATION PUMP

(75) Inventors: Alexander Govyadinov, Corvallis, OR (US); Paul J Benning, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/698,053

(22) PCT Filed: Jan. 31, 2011

(86) PCT No.: PCT/US2011/023173
§ 371 (c)(1), (2), (4) Date: Nov. 15, 2012

(87) PCT Pub. No.: WO2011/146149
PCT Pub. Date: Nov. 24, 2011

(65) Prior Publication Data

US 2013/0063528 A1 Mar. 14, 2013

Related U.S. Application Data

(63) Continuation-in-part of application No. 12/833,984, filed on Jul. 11, 2010, now Pat. No. 8,540,355, and a continuation-in-part of application No. PCT/US2011/021168, filed on Jan. 13, 2011, and a continuation-in-part of application No. PCT/US2010/054458, filed on Oct. 28, 2010, and a continuation-in-part of application No. PCT/US2010/054412, filed on Oct. 28, 2010, and a continuation-in-part of application No. PCT/US2010/043480, filed on Jul. 28, 2010, and a continuation-in-part of application No. PCT/US2010/035697, filed on May 21, 2010.

(51) Int. Cl.
*B41J 2/18* (2006.01)
*B41J 2/05* (2006.01)

(52) U.S. Cl.
USPC ..... 347/89; 347/65

(58) Field of Classification Search
None
See application file for complete search history.

(56) References Cited

U.S. PATENT DOCUMENTS 4,318,114 A 3/1982 Huliba
5,412,411 A 5/1995 Anderson (Continued)

FOREIGN PATENT DOCUMENTS

JP 10175307 6/1998
JP 2001-205810 7/2001

(Continued)

OTHER PUBLICATIONS

Daniel C. Leslie, et. al.; Frequency-specific Flow Control in Microfluidic Circuits with Passive Elastomeric Features; Nature Physics, Feb. 1, 2009: pp. 231-235.

(Continued)

*Primary Examiner* — Geoffrey Mruk
(74) *Attorney, Agent, or Firm* — Nathan R. Rieth

(57) ABSTRACT

A fluid ejection device includes a fluid recirculation channel, and a drop generator disposed within the channel. A fluid slot is in fluid communication with each end of the channel, and a piezoelectric fluid actuator is located asymmetrically within the recirculation channel to cause fluid flow from the fluid slot, through the recirculation channel and drop generator, and back to the fluid slot.

18 Claims, 9 Drawing Sheets

(56) References Cited

U.S. PATENT DOCUMENTS

| | | | | |
|---|---|---|---|---|
| 5,818,485 | A | 10/1998 | Rezanka | |
| 6,010,316 | A | 1/2000 | Haller et al. | |
| 6,055,002 | A | 4/2000 | Wen et al. | |
| 6,106,091 | A | 8/2000 | Osawa et al. | |
| 6,152,559 | A | 11/2000 | Kojima | |
| 6,227,660 | B1 | 5/2001 | McClelland et al. | |
| 6,244,694 | B1 * | 6/2001 | Weber et al. | 347/65 |
| 6,283,718 | B1 | 9/2001 | Prosperetti et al. | |
| 6,351,879 | B1 * | 3/2002 | Furlani et al. | 29/25.35 |
| 6,431,694 | B1 | 8/2002 | Ross | |
| 6,467,887 | B2 | 10/2002 | Lopez et al. | |
| 6,568,799 | B1 | 5/2003 | Yang et al. | |
| 6,631,983 | B2 | 10/2003 | Romano, Jr. et al. | |
| 6,655,924 | B2 | 12/2003 | Ma | |
| 6,752,493 | B2 | 6/2004 | Dowell et al. | |
| 6,910,797 | B2 | 6/2005 | Falcon | |
| 6,953,236 | B2 | 10/2005 | Silverbrook | |
| 7,040,745 | B2 | 5/2006 | Kent | |
| 7,049,558 | B2 | 5/2006 | Baer et al. | |
| 7,097,287 | B2 | 8/2006 | Nakao et al. | |
| 7,118,189 | B2 | 10/2006 | Kuester et al. | |
| 7,182,442 | B2 | 2/2007 | Sheinman | |
| 7,204,585 | B2 | 4/2007 | Bruinsma et al. | |
| 7,470,004 | B2 | 12/2008 | Eguchi et al. | |
| 7,543,923 | B2 | 6/2009 | McNestry | |
| 7,763,453 | B2 | 7/2010 | Clemmens et al. | |
| 7,832,429 | B2 | 11/2010 | Young et al. | |
| 2007/0291082 | A1 | 12/2007 | Baumer et al. | |
| 2008/0007604 | A1 | 1/2008 | Kang et al. | |
| 2008/0055378 | A1 | 3/2008 | Drury et al. | |
| 2008/0079791 | A1 | 4/2008 | Kang et al. | |
| 2008/0143793 | A1 | 6/2008 | Okuda | |
| 2008/0260582 | A1 | 10/2008 | Gauer et al. | |
| 2009/0027458 | A1 | 1/2009 | Leighton et al. | |
| 2009/0040257 | A1 | 2/2009 | Bergstedt et al. | |
| 2009/0079789 | A1 | 3/2009 | Silverbrook | |
| 2009/0246086 | A1 | 10/2009 | Barbier et al. | |
| 2009/0270834 | A1 | 10/2009 | Nisato et al. | |
| 2009/0297372 | A1 | 12/2009 | Amirouche et al. | |
| 2010/0013887 | A1 | 1/2010 | Suh | |
| 2010/0173393 | A1 | 7/2010 | Handique et al. | |

FOREIGN PATENT DOCUMENTS

| | | |
|---|---|---|
| JP | 2001-322099 | 11/2001 |
| JP | 2003528276 | 9/2003 |
| JP | 2004-249741 | 9/2004 |
| JP | 2006512545 | 4/2006 |
| JP | 2006156894 | 6/2006 |
| JP | 2009117344 | 5/2009 |
| KR | 20030059797 | 7/2003 |
| KR | 20080004095 | 1/2008 |
| KR | 20090108371 | 10/2009 |

OTHER PUBLICATIONS

Fadl et al; "The effect of the Microfluidic Diodicity on the Efficiency of Valve-Less Rectification Micopumps Using Lattice Boltzmann Method", Microsyst Technol: Jul. 2009.

Inkjet Photo Printers, Ink, Paper, and Laser Toner Tool; Inkjet Printers Paper Reviews; inkjethelper.com.

Koltay et al; "Non-Contact Liquid Handling: Basics and Technologies"; http://www.labautopedia.com/mw/index/php/Non-Contact Liquid Handling: Basics and Technologies.

Sonia Ramirez-Garcia, et. al.; Towards the Development of a Fully Integrated Polymeric Microfluidic Platform for Environmental Analysis; Elesvier B.V.; Apr. 12, 2008; p. 46.

* cited by examiner

FLUID EJECTION DEVICE WITH CIRCULATION PUMP

BACKGROUND

Fluid ejection devices in inkjet printers provide drop-on-demand ejection of fluid drops. Inkjet printers produce images by ejecting ink drops through a plurality of nozzles onto a print medium, such as a sheet of paper. The nozzles are typically arranged in one or more arrays, such that properly sequenced ejection of ink drops from the nozzles causes characters or other images to be printed on the print medium as the printhead and the print medium move relative to each other. In a specific example, a thermal inkjet printhead ejects drops from a nozzle by passing electrical current through a heating element to generate heat and vaporize a small portion of the fluid within a firing chamber. In another example, a piezoelectric inkjet printhead uses a piezoelectric material actuator to generate pressure pulses that force ink drops out of a nozzle.

Although inkjet printers provide high print quality at reasonable cost, continued improvement relies on overcoming various challenges that remain in their development. For example, air bubbles released from the ink during printing can cause problems such as ink flow blockage, print quality degradation, partly full print cartridges appearing to be empty, and ink leaks. Pigment-ink vehicle separation (PIVS) is another problem encountered when using pigment-based inks. PIVS is typically a result of water evaporation from ink in the nozzle area and pigment concentration depletion in ink near the nozzle area due to a higher affinity of pigment to water. During periods of storage or non-use, pigment particles can also settle or crash out of the ink vehicle which can impede or completely block ink flow to the firing chambers and nozzles in the printhead. Other factors related to "decap", such as evaporation of water or solvent can affect local ink properties such PIVS and viscous ink plug formation. Decap is the amount of time inkjet nozzles can remain uncapped and exposed to ambient environments without causing degradation in the ejected ink drops. Effects of decap can alter drop trajectories, velocities, shapes and colors, all of which can negatively impact the print quality of an inkjet printer.

BRIEF DESCRIPTION OF THE DRAWINGS

The present embodiments will now be described, by way of example, with reference to the accompanying drawings, in which.

DETAILED DESCRIPTION

Overview of Problem and Solution

Figure 1:
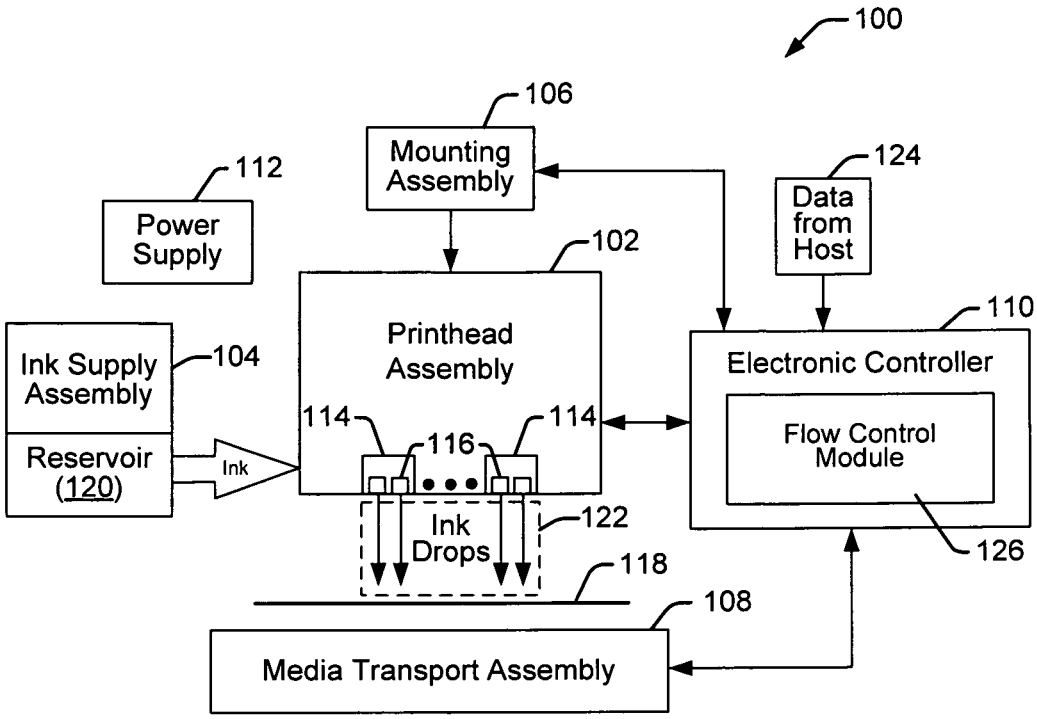
FIG. 1 illustrates a fluid ejection device embodied as an inkjet printing system, according to an embodiment.

As noted above, various challenges have yet to be overcome in the development of inkjet printing systems. For example, inkjet printheads used in such systems continue to have troubles with ink blockage and/or clogging. One cause of ink blockage is an excess of air that accumulates as air bubbles in the printhead. When ink is exposed to air, such as while the ink is stored in an ink reservoir, additional air dissolves into the ink. The subsequent action of ejecting ink drops from the firing chamber of the printhead releases excess air from the ink which then accumulates as air bubbles. The bubbles move from the firing chamber to other areas of the printhead where they can block the flow of ink to the printhead and within the printhead.

Pigment-based inks can also cause ink blockage or clogging in printheads. Inkjet printing systems use pigment-based inks and dye-based inks, and while there are advantages and disadvantages with both types of ink, pigment-based inks are generally preferred. In dye-based inks the dye particles are dissolved in liquid so the ink tends to soak deeper into the paper. This makes dye-based ink less efficient and it can reduce the image quality as the ink bleeds at the edges of the image. Pigment-based inks, by contrast, consist of an ink vehicle and high concentrations of insoluble pigment particles coated with a dispersant that enables the particles to remain suspended in the ink vehicle. This helps pigment inks stay more on the surface of the paper rather than soaking into the paper. Pigment ink is therefore more efficient than dye ink because less ink is needed to create the same color intensity in a printed image. Pigment inks also tend to be more durable and permanent than dye inks as they smear less than dye inks when they encounter water.

One drawback with pigment-based inks, however, is that ink blockage can occur in the inkjet printhead due to factors such as prolonged storage and other environmental extremes which can result in poor out-of-box performance of inkjet pens. Inkjet pens have a printhead affixed at one end that is internally coupled to an ink supply. The ink supply may be self-contained within the pen body or it may reside on the printer outside the pen and be coupled to the printhead through the pen body. Over long periods of storage, gravitational effects on the large pigment particles and/or degradation of the dispersant can cause pigment settling or crashing. The settling or crashing of pigment particles can impede or completely block ink flow to the firing chambers and nozzles in the printhead, resulting in poor out-of-box performance by the printhead and reduced image quality from the printer. Other factors such as evaporation of water and solvent from the ink can also contribute to PIVS and/or increased ink viscosity and viscous plug formation, which can decrease decap performance and prevent immediate printing after periods of non-use.

Previous solutions to such problems have primarily involved servicing printheads before and after their use, as well as using various types of external pumps for mixing the ink. For example, printheads are typically capped during non-use to prevent nozzles from clogging with dried ink. Prior to their use, nozzles can also be primed by spitting ink through them. Drawbacks to these solutions include the inability to print immediately due to the servicing time, and an increase in the total cost of ownership due to the significant amount of ink consumed during servicing. The use of external pumps for mixing ink is typically cumbersome and expensive, while often only partially resolving the inkjet problems. Accordingly, decap performance, PIVS, the accumulation of air and particulates, and other causes of ink blockage and/or clogging in inkjet printing systems continue to be fundamental problems that can degrade overall print quality and increase ownership costs, manufacturing costs, or both.

Embodiments of the present disclosure reduce ink blockage and/or clogging in inkjet printing systems generally through the use of piezoelectric and other types of mechanically controllable fluid actuators that provide fluid circulation to drop generators within fluid recirculation channels. A fluid actuator located asymmetrically within a recirculation channel and a controller enable directional fluid flow through the channel to a drop generator by controlling the durations of forward and reverse actuation strokes (i.e., pump strokes) that generate compressive fluid displacements (i.e., on forward pump strokes) and tensile fluid displacements (i.e., on reverse pump strokes).

In one example embodiment, a fluid ejection device includes a fluid recirculation channel. A drop generator is disposed within the recirculation channel. A fluid slot is in fluid communication with each end of the recirculation channel, and a piezoelectric fluid actuator is located asymmetrically within the channel to cause fluid to flow from the fluid slot, through the channel and drop generator, and back to the fluid slot. In one implementation, the device includes a controller to control the direction of fluid flow by causing the piezoelectric fluid actuator to generate compressive and tensile fluid displacements of controlled duration.

In another example embodiment, a method of ejecting fluid from a fluid ejection device includes, in a fluid recirculation channel having a drop generator, controlling the duration of compressive and tensile fluid displacements to cause fluid to flow from a fluid slot, through the drop generator and back to the fluid slot. The method includes ejecting fluid through a nozzle as it flows through the drop generator. Controlling the duration of compressive and tensile fluid displacements includes generating compressive fluid displacements of a first duration, and generating tensile fluid displacements of a second duration different from the first duration.

In another example embodiment, a fluid ejection device includes a drop ejector in a fluid recirculation channel, and a fluid control system to control the direction, rate and timing, of fluid flow through the recirculation channel and the drop ejector. The fluid control system includes a fluid actuator integrated within the recirculation channel, and a controller with executable instructions to cause the fluid actuator to generate temporally asymmetric compressive and tensile fluid displacements within the recirculation channel that drive the fluid flow.

Illustrative Embodiments

FIG. 1 illustrates a fluid ejection device embodied as an inkjet printing system 100, according to an embodiment of the disclosure. In this embodiment, a fluid ejection assembly is disclosed as a fluid drop jetting printhead 114. Inkjet printing system 100 includes an inkjet printhead assembly 102, an ink supply assembly 104, a mounting assembly 106, a media transport assembly 108, an electronic printer controller 110, and at least one power supply 112 that provides power to the various electrical components of inkjet printing system 100. Inkjet printhead assembly 102 includes at least one fluid ejection assembly 114 (printhead 114) that ejects drops of ink through a plurality of orifices or nozzles 116 toward a print medium 118 so as to print onto print media 118. Print media 118 can be any type of suitable sheet or roll material, such as paper, card stock, transparencies, Mylar, and the like. Nozzles 116 are typically arranged in one or more columns or arrays such that properly sequenced ejection of ink from nozzles 116 causes characters, symbols, and/or other graphics or images to be printed on print media 118 as inkjet printhead assembly 102 and print media 118 are moved relative to each other.

Ink supply assembly 104 supplies fluid ink to printhead assembly 102 and includes a reservoir 120 for storing ink. Ink flows from reservoir 120 to inkjet printhead assembly 102. Ink supply assembly 104 and inkjet printhead assembly 102 can form either a one-way ink delivery system or a macro-recirculating ink delivery system. In a one-way ink delivery system, substantially all of the ink supplied to inkjet printhead assembly 102 is consumed during printing. In a macro-recirculating ink delivery system, however, only a portion of the ink supplied to printhead assembly 102 is consumed during printing. Ink not consumed during printing is returned to ink supply assembly 104.

In one embodiment, inkjet printhead assembly 102 and ink supply assembly 104 are housed together in an inkjet cartridge or pen. In another embodiment, ink supply assembly 104 is separate from inkjet printhead assembly 102 and supplies ink to inkjet printhead assembly 102 through an interface connection, such as a supply tube. In either embodiment, reservoir 120 of ink supply assembly 104 may be removed, replaced, and/or refilled. Where inkjet printhead assembly 102 and ink supply assembly 104 are housed together in an inkjet cartridge, reservoir 120 includes a local reservoir located within the cartridge as well as a larger reservoir located separately from the cartridge. The separate, larger reservoir serves to refill the local reservoir. Accordingly, the separate, larger reservoir and/or the local reservoir may be removed, replaced, and/or refilled.

Mounting assembly 106 positions inkjet printhead assembly 102 relative to media transport assembly 108, and media transport assembly 108 positions print media 118 relative to inkjet printhead assembly 102. Thus, a print zone 122 is defined adjacent to nozzles 116 in an area between inkjet printhead assembly 102 and print media 118. In one embodiment, inkjet printhead assembly 102 is a scanning type printhead assembly. As such, mounting assembly 106 includes a carriage for moving inkjet printhead assembly 102 relative to media transport assembly 108 to scan print media 118. In another embodiment, inkjet printhead assembly 102 is a non-scanning type printhead assembly. As such, mounting assembly 106 fixes inkjet printhead assembly 102 at a prescribed position relative to media transport assembly 108. Thus, media transport assembly 108 positions print media 118 relative to inkjet printhead assembly 102.

Electronic printer controller 110 typically includes a processor, firmware, software, one or more memory components including volatile and no-volatile memory components, and other printer electronics for communicating with and controlling inkjet printhead assembly 102, mounting assembly 106, and media transport assembly 108. Electronic controller 110 receives data 124 from a host system, such as a computer, and temporarily stores data 124 in a memory. Typically, data 124 is sent to inkjet printing system 100 along an electronic, infrared, optical, or other information transfer path. Data 124 represents, for example, a document and/or file to be printed. As such, data 124 forms a print job for inkjet printing system 100 and includes one or more print job commands and/or command parameters.

In one embodiment, electronic printer controller 110 controls inkjet printhead assembly 102 for ejection of ink drops from nozzles 116. Thus, electronic controller 110 defines a pattern of ejected ink drops which form characters, symbols, and/or other graphics or images on print media 118. The pattern of ejected ink drops is determined by the print job commands and/or command parameters. In one embodiment, electronic controller 110 includes flow control module 126 stored in a memory of controller 110. Flow control module 126 executes on electronic controller 110 (i.e., a processor of controller 110) to control the operation of one or more fluid actuators integrated as pump elements within fluid ejection assemblies 114. More specifically, controller 110 executes instructions from module 126 to control the timing and duration of forward and reverse pumping strokes (compressive and tensile fluid displacements, respectively) of the fluid actuators in order to control the direction, rate, and timing of fluid flow within fluid ejection assemblies 114.

In one embodiment, inkjet printhead assembly 102 includes one fluid ejection assembly (printhead) 114. In another embodiment, inkjet printhead assembly 102 is a wide array or multi-head printhead assembly. In one implementation of a wide-array assembly, inkjet printhead assembly 102 includes a carrier that carries fluid ejection assemblies 114, provides electrical communication between fluid ejection assemblies 114 and electronic controller 110, and provides fluidic communication between fluid ejection assemblies 114 and ink supply assembly 104.

In one embodiment, inkjet printing system 100 is a drop-on-demand thermal bubble inkjet printing system wherein the fluid ejection assembly 114 is a thermal inkjet (TIJ) printhead. The thermal inkjet printhead implements a thermal resistor ejection element in an ink chamber to vaporize ink and create bubbles that force ink or other fluid drops out of a nozzle 116. In another embodiment, inkjet printing system 100 is a drop-on-demand piezoelectric inkjet printing system wherein the fluid ejection assembly 114 is a piezoelectric inkjet (PIJ) printhead that implements a piezoelectric material actuator as an ejection element to generate pressure pulses that force ink drops out of a nozzle.

Figure 2:
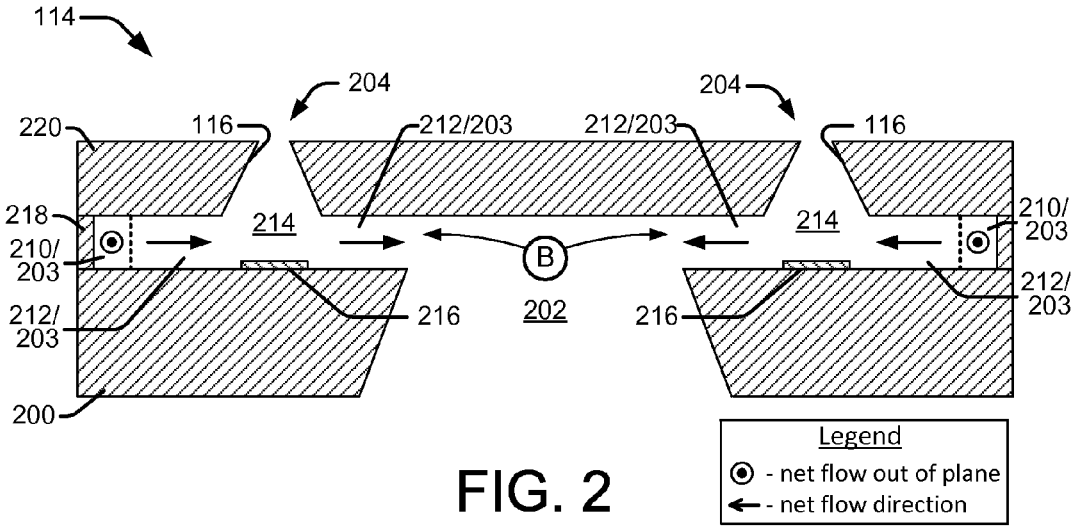
FIG. 2 shows a cross-sectional view of a fluid ejection assembly, according to an embodiment.
Figure 3:
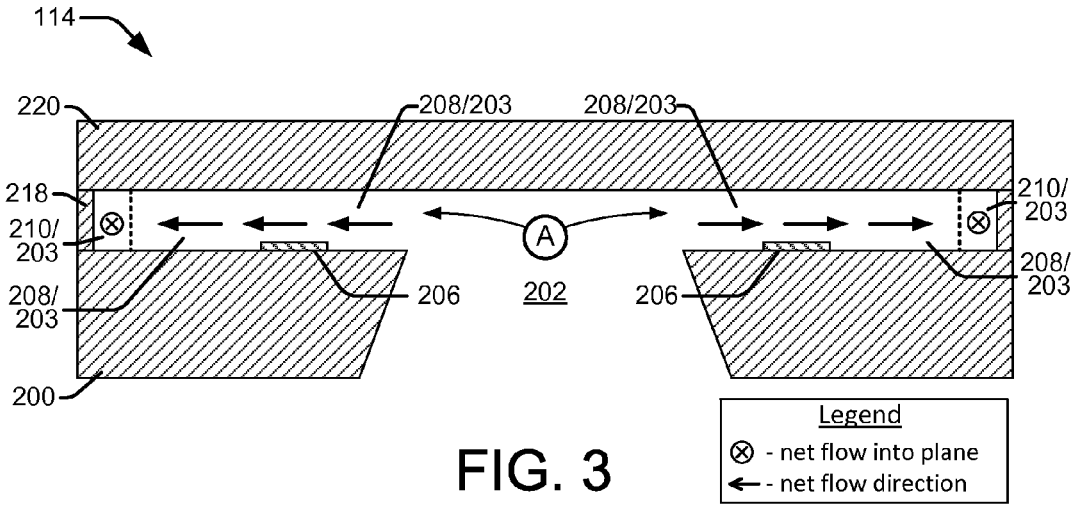
FIG. 3 shows a cross-sectional view of a fluid ejection assembly, according to an embodiment.
Figure 4A:
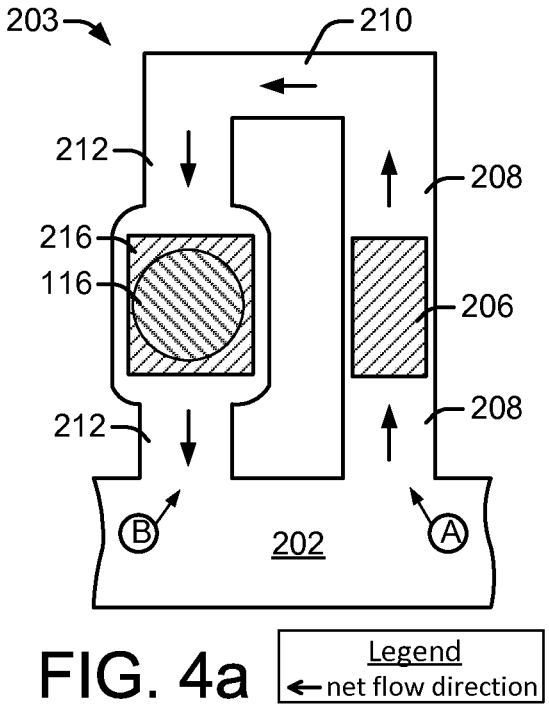
FIGS. 4*a* and 4*b* show partial top-down views of a recirculation channel within a fluid ejection assembly, according to embodiments.
Figure 4B:
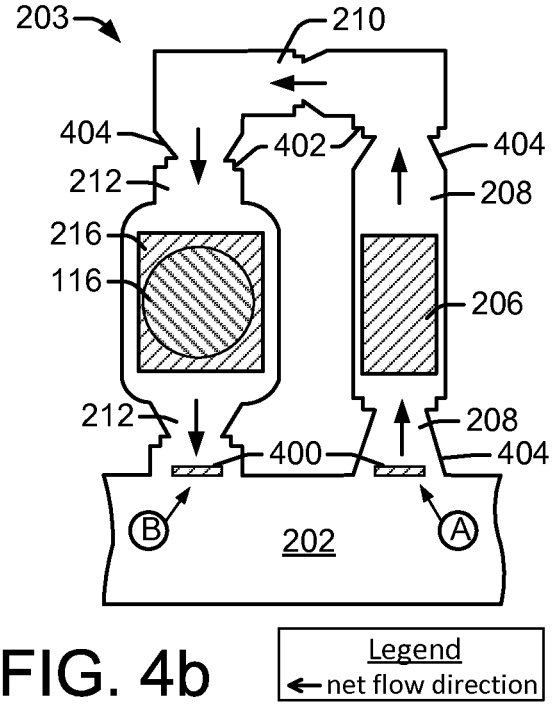

FIGS. 2 and 3 show cross-sectional views of a fluid ejection assembly 114, according to an embodiment of the disclosure. FIG. 2 shows a cross-sectional view of the fluid ejection assembly 114 cut through a drop generator 204, while FIG. 3 shows a cross-sectional view of the fluid ejection assembly 114 cut through a fluid actuator 206 (fluid pump element 206). FIGS. 4*a* and 4*b* show partial top-down views of a recirculation channel within a fluid ejection assembly 114, according to embodiments of the disclosure.

Referring generally to FIGS. 2, 3 and 4, the fluid ejection assembly 114 includes a substrate 200 with a fluid slot 202 formed therein. A chamber layer has walls 218 that define fluid chambers 214 and separate the substrate 200 from a nozzle layer 220 having nozzles 116. The fluid slot 202 is an elongated slot extending into the plane of FIGS. 2 and 3 that is in fluid communication with a fluid supply (not shown), such as a fluid reservoir 120 (FIG. 1). In general, fluid from fluid slot 202 circulates through recirculation channel 203 and drop generator 204 based on flow induced by a fluid actuator 206 or fluid pump element 206. The recirculation channel 203 extends from the fluid slot 202 at one end (e.g., point "A") and back to the fluid slot 202 at another end (e.g., point "B"), and generally includes three sections referred to herein as the inlet channel 208, the connection channel 210, and the outlet channel 212. However, depending on the direction of fluid flow through the recirculation channel 203, the inlet channel 208 is not necessarily where fluid flows into the recirculation channel 203 from the fluid slot 202, and the outlet channel 212 is not necessarily where fluid flows out of the recirculation channel 203 back to the fluid slot 202. Thus, fluid from fluid slot 202 can flow through the recirculation channel 203 in either direction, entering at the inlet channel 208 (point "A") and exiting at the outlet channel 212 (point "B"), or entering at the outlet channel 212 (point "B") and exiting at the inlet channel 208 (point "A"). The direction of flow, as discussed below, depends on fluid displacements generated by the fluid actuator 206.

The recirculation channel 203 includes a drop generator 204 and fluid actuator 206. Recirculation channels 203, each having a drop generator 204, are arranged on either side of the fluid slot 202 and along the length of the slot 202 extending into the plane of FIGS. 2 and 3. A drop generator 204 includes a nozzle 116, a fluid chamber 214, and an ejection element 216 disposed within the chamber 214. Drop generators 204 (i.e., the nozzles 116, chambers 214, and ejection elements 216) can be organized into groups referred to as primitives, where each primitive includes a group of adjacent ejection elements 216. A primitive typically includes a group of twelve drop generators 204, but may include different numbers such as six, eight, ten, fourteen, sixteen, and so on.

Ejection elements 216 are illustrated generally in FIGS. 2-4, and can be any device capable of ejecting fluid drops through a corresponding nozzle 116, such as a thermal resistor or piezoelectric actuator, for example. A thermal resistor ejection element is typically formed of an oxide layer on the surface of the substrate 200, and a thin film stack that includes an oxide layer, a metal layer and a passivation layer (individual layers are not specifically illustrated). When activated, heat from the thermal ejection element vaporizes fluid in the chamber 214, causing a bubble that ejects a fluid drop through the nozzle 116. A piezoactuator ejection element generally includes a piezoelectric material adhered to a moveable membrane formed at the bottom of the chamber 214. When activated, the piezoelectric material causes deflection of the membrane into the chamber 214, generating a pressure pulse that ejects a fluid drop through the nozzle 116.

Fluid actuator 206 is generally described herein as being a piezoelectric membrane whose forward and reverse deflections (or, up and down deflections, sometimes referred to as piston strokes) within the recirculation channel 203 generate fluid displacements that can be temporally controlled. However, a variety of other devices can also be used to implement the fluid actuator 206 including, for example, an electrostatic (MEMS) membrane, a mechanical/impact driven membrane, a voice coil, a magneto-strictive drive, and so on.

The respective locations of the drop generator 204 and fluid actuator 206 within the recirculation channel 203 are typically, but not necessarily, toward opposite sides of the channel 203. Thus, the drop generator 204 can be located in the outlet channel 212 while the fluid actuator 206 is in the inlet channel 208, as shown in FIG. 4, or their respective locations can be reversed, with the drop generator 204 being in the inlet channel 208 and the fluid actuator 206 being in the outlet channel 212. The exact location of the fluid actuator 206 toward either end of the recirculation channel 203 may vary somewhat, but in any case will be asymmetrically located with respect to the center point of the length of the recirculation channel 203. For example, the approximate center point of the recirculation channel 203 is located somewhere within the connection channel 210 (FIG. 4) between points "A" and "B". The recirculation channel 203 extends from one end adjacent the fluid slot 202 at point "A", to an opposite end adjacent the fluid slot 202 at point "B".

The asymmetric location of the fluid actuator 206 within the recirculation channel 203 is one component of an inertial pump mechanism that needs to be met in order to achieve a pumping effect that can generate a net fluid flow through the channel 203. The asymmetric location of the fluid actuator 206 within the recirculation channel 203 creates a short side of the recirculation channel 203 that extends a short distance from the fluid actuator 206 to the fluid slot 202 at point "A", and a long side of the recirculation channel 203 that extends around the remaining length of the channel 203 from the fluid actuator 206 back to the fluid slot 202 at point "B". The pumping effect of the fluid actuator 206 depends on its asymmetric placement within a fluidic channel (e.g., recirculation channel 203) whose width is narrower than the width of the fluid slot 202 (or other fluid reservoir) from which fluid is being pumped. The asymmetric location of the fluid actuator 206 within the recirculation channel 203 creates an inertial mechanism that drives fluidic diodicity (net fluid flow) within the channel 203. The fluid actuator 206 generates a wave propagating within the recirculation channel 203 that pushes fluid in two opposite directions along the channel 203. When the fluid actuator 206 is located asymmetrically within the recirculation channel 203, there can be a net fluid flow through the channel 203. The more massive part of the fluid (contained, typically, in the longer side of the recirculation channel 203) has larger mechanical inertia at the end of a forward fluid actuator pump stroke. Therefore, this larger body of fluid reverses direction more slowly than the liquid in the shorter side of the channel 203. The fluid in the shorter side of the channel 203 has more time to pick up the mechanical momentum during the reverse fluid actuator pump stroke. Thus, at the end of the reverse stroke the fluid in the shorter side of the channel 203 has larger mechanical momentum than the fluid in the longer side of the channel 203. As a result, the net flow is typically in the direction from the shorter side to the longer side of the channel 203, as indicated by the black direction arrows in FIGS. 2-4. The net fluid flow is a consequence of non-equal inertial properties of two fluidic elements (i.e., the short and long sides of the channel).

As shown in FIG. 4*b*, in some fluid ejection device examples, a recirculation channel 203 includes various shapes and architectures located in the inlet 208, outlet 212, and connection 210 channels, that are intended to promote fluid flow in a particular direction, prevent various particulates from interrupting fluid flow, and control blowback of printing fluid during drop ejection. For example, the recirculation channel 203 shown in FIG. 4*b* includes particle tolerant architectures 400. As used herein, particle tolerant architectures (PTA) refer to barrier objects that are placed in the printing fluid path to prevent particles from interrupting ink or printing fluid flow. In some examples, particle tolerant architectures 400 prevent dust and particles from blocking fluid chambers 214 and/or nozzles 116. A recirculation channel 203 can also include pinch points 402 that are used to control blowback of printing fluid during drop ejection. A recirculation channel 203 can also include non-moving part valves 404. As used herein, non-moving part valve (NMPV) refers to a non-moving object that is positioned and/or designed to regulate the flow of fluid. The presence of non-moving part valves 404 can improve the recirculation efficiency and minimize nozzle cross talk, which refers to an unintended flow of fluid between neighboring drop generators 204 and/or pumps 206.

In addition to the asymmetric placement of the fluid actuator 206 within the recirculation channel 203, another component of an inertial pump mechanism that needs to be met in order to achieve a pumping effect that can generate a net fluid flow through the recirculation channel 203, is temporal asymmetry of the fluid displacements generated by the fluid actuator 206. That is, to achieve the pumping effect and a net fluid flow through the channel 203 and drop generator 204, the fluid actuator 206 should also operate asymmetrically with respect to its displacement of fluid within the channel 203. During operation, the fluid actuator 206 first deflects upward, into the channel 203 with a forward stroke (i.e., the flexible membrane flexes upward, acting as a forward piston stroke), and then deflects downward, out of the channel 203 with a reverse stroke (i.e., the flexible membrane flexes back down, acting as a reverse piston stroke). As noted above, a fluid actuator 206 generates a wave propagating in the channel 203 that pushes fluid in two opposite directions along the channel 203. If the operation of the fluid actuator 206 is such that its deflections displace fluid in both directions with the same speed, then the fluid actuator 206 will generate little or no net fluid flow in the channel 203. To generate net fluid flow, the operation of the fluid actuator 206 should be controlled so that its deflections, or fluid displacements, are not symmetric. Therefore, asymmetric operation of the fluid actuator 206 with respect to the timing of its deflection strokes, or fluid displacements, is a second condition that needs to be met in order to achieve a pumping effect that can generate a net fluid flow through the recirculation channel 203.

Figure 5A:
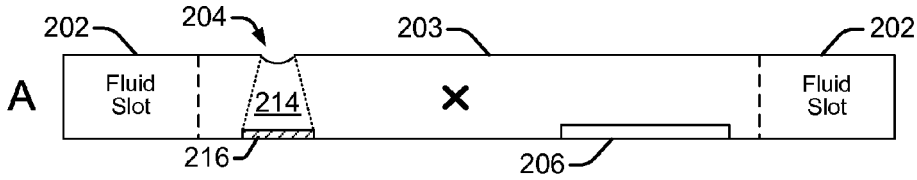
FIGS. 5*a*, 5*b* and 5*c* show side views of a recirculation channel with an integrated fluid actuator in different stages of operation, according to embodiments.
Figure 5B:
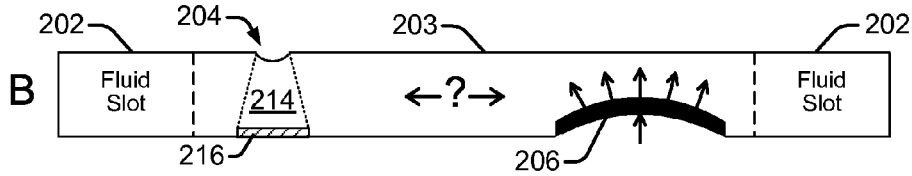
Figure 5C:
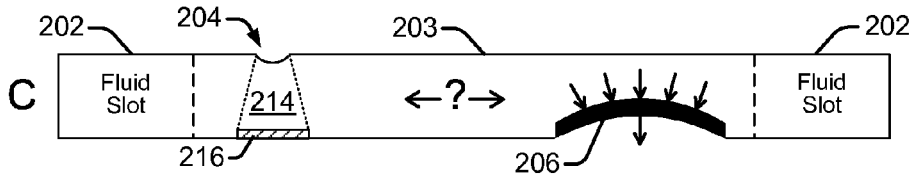

FIGS. 5*a*, 5*b* and 5*c* show side views of a recirculation channel 203 with an integrated fluid actuator 206 in different stages of operation, according to embodiments of the disclosure. The recirculation channel 203 of FIGS. 5*a*, 5*b* and 5*c*, is the same as shown in FIG. 4, but is illustrated in a linear fashion to aid the description. Accordingly, each end of the recirculation channel 203 is in fluid communication with the fluid slot 202. The fluid actuator 206 is asymmetrically placed at the short side of the channel 203, satisfying the first condition needed to create a pumping effect that can generate a net fluid flow through the channel 203. The drop generator 204 is located in the recirculation channel 203 opposite the fluid actuator 206, toward the other end of the channel 203. The second condition that needs to be satisfied to create a pump effect is an asymmetric operation of the fluid actuator 206, as noted above.

At operating stage A, shown in FIG. 5*a*, the fluid actuator 206 is in a resting position and is passive, so there is no net fluid flow through the channel 203. At operating stage B, shown in FIG. 5*b*, the fluid actuator 206 is active and the membrane is deflected upward into the channel 203. This upward deflection, or forward stroke, causes a compressive (positive) displacement of fluid within the channel 203 as the membrane pushes the fluid outward. At operating stage C, shown in FIG. 5*c*, the fluid actuator 206 is active and the membrane is beginning to deflect downward to return to its original resting position. This downward deflection, or reverse stroke, of the membrane causes a tensile (negative) displacement of fluid within the channel 203 as it pulls the fluid downward. An upward and downward deflection is one deflection cycle. A net fluid flow is generated through the channel 203 if there is temporal asymmetry between the upward deflection (i.e., the compressive displacement) and the downward deflection (i.e., the tensile displacement) in repeating deflection cycles. Temporal asymmetry and net fluid flow direction are discussed below with reference to FIGS. 6-13. Therefore, FIGS. 5*b* and 5*c* include question marks between opposite net flow direction arrows for the operating stages B and C, respectively, to indicate that the temporal asymmetry between the compressive and tensile displacements has not been specified and therefore the direction of flow, if any, is not yet known.

Figure 6A:
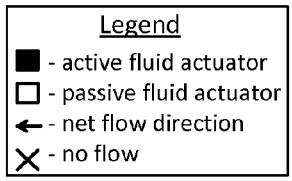
FIGS. 6*a* and 6*b* show an active fluid actuator with time markers at different operating stages, according to embodiments.
Figure 6A:
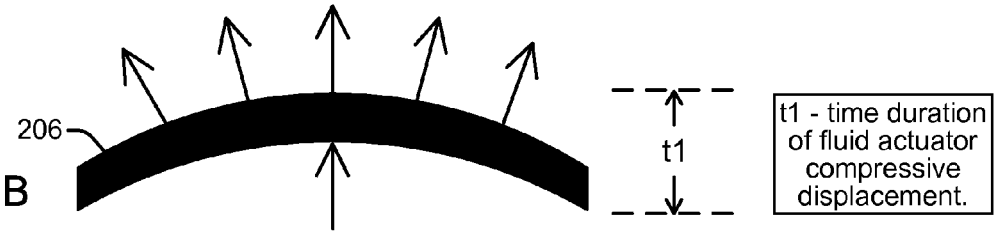
Figure 6B:
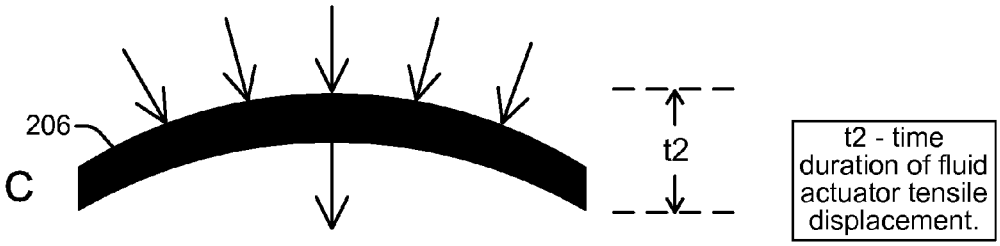

FIGS. 6*a* and 6*b* show the active fluid actuator 206 at the operating stages B and C from FIGS. 5*b* and 5*c*, respectively, along with time markers "t1" and "t2" to help illustrate temporal asymmetry between compressive and tensile displacements generated by the fluid actuator 206, according to an embodiment of the disclosure. The time t1 is the time it takes for the fluid actuator membrane to deflect upward, generating a compressive fluid displacement. The time t2 is the time it takes for the fluid actuator membrane to deflect downward, or back to its original position, generating a tensile fluid displacement. Asymmetric operation of the fluid actuator 206 occurs if the t1 duration of the compressive displacement (upward membrane deflection) is greater or lesser than (i.e., not the same as) the t2 duration of the tensile displacement (downward membrane deflection). Such asymmetric fluid actuator 206 operation over repeating deflection cycles generates a net fluid flow within the recirculation channel 203 and through drop generator 204. However, if the t1 and t2 compressive and tensile displacements are equal, or symmetric, there will be little or no net fluid flow through the channel 203, regardless of the asymmetric placement of the fluid actuator 206 within the channel 203.

Figure 10:
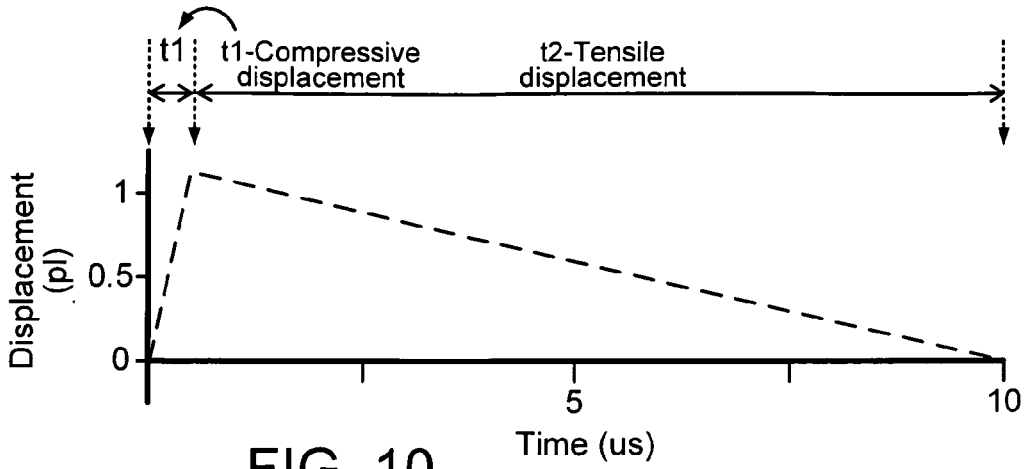
FIGS. 10, 11 and 12 show example displacement pulse waveforms whose durations correspond with fluid actuator displacement durations, according to embodiments.
Figure 11:
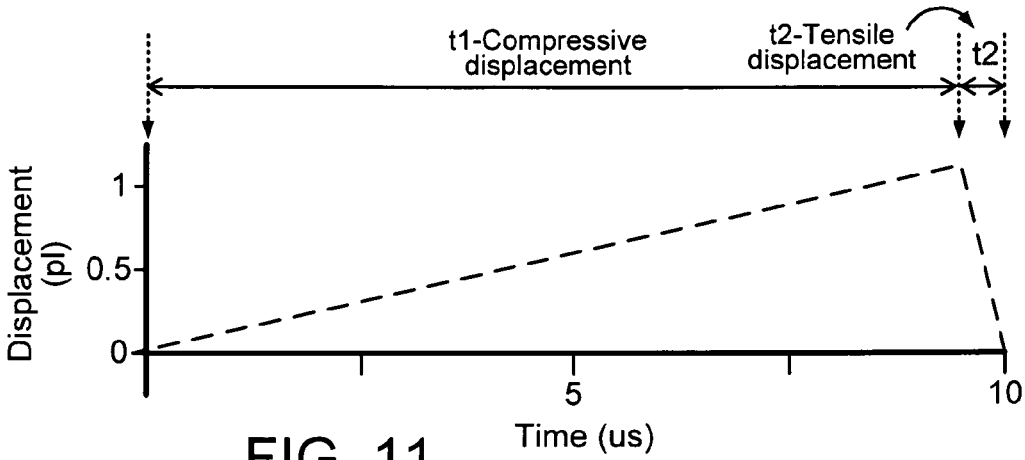
Figure 12:
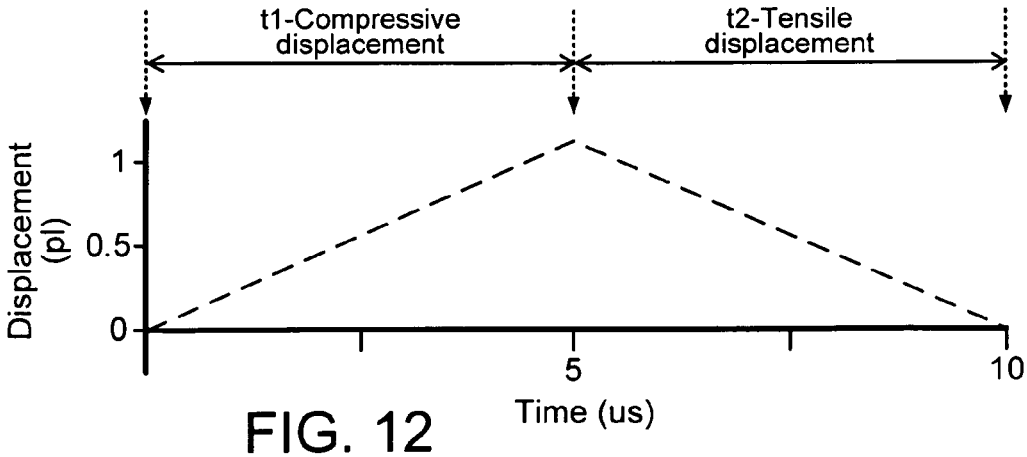

FIGS. 7*a*, 7*b*, 8*a*, 8*b*, 9*a* and 9*b* show the active fluid actuator 206 at the operating stages B and C from FIGS. 5*b* and 5*c*, respectively, including net fluid flow direction arrows that indicate which direction fluid flows through the recirculation channel 203 and drop generator 204, if at all, according to embodiments of the disclosure. The direction of the net fluid flow depends on the compressive (positive) and tensile (negative) displacement durations (t1 and t2) from the actuator. FIGS. 10, 11 and 12 show example displacement pulse waveforms whose durations correspond respectively with the displacement durations t1 and t2 of FIGS. 7, 8 and 9. For a piezoelectric fluid actuator 203, the compressive displacement and tensile displacement times, t1 and t2, can be precisely controlled by an electronic controller 110, for example, executing instructions such as from a flow control module 112 within a fluid ejection device 100, such as in FIG. 1.

Figure 7A:
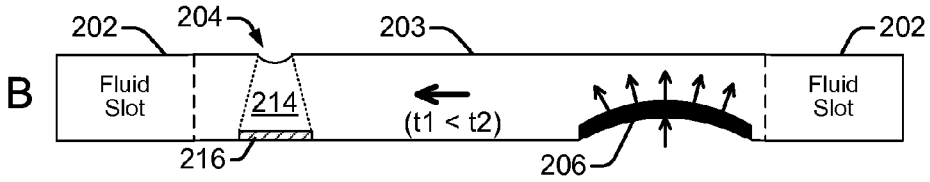
FIGS. 7*a*, 7*b*, 8*a*, 8*b*, 9*a* and 9*b* show an active fluid actuator at different operating stages indicating the direction of fluid flow through a recirculation channel and drop generator, according to embodiments.
Figure 7B:
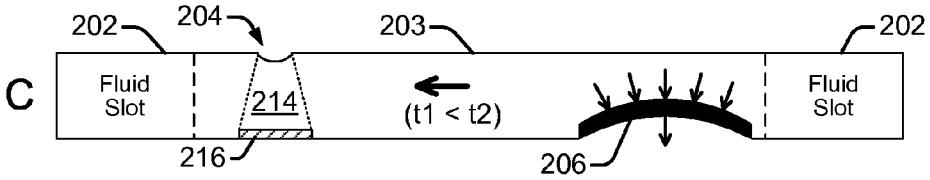

Referring to FIGS. 7*a* and 7*b*, the compressive displacement duration, t1, is less than the tensile displacement duration, t2, so there is a net fluid flow in a direction from the short side of the recirculation channel 203 (i.e., the side where the actuator is located) to the long side of the channel through drop generator 204. As fluid flows through the chamber 214 of drop generator 204, some fluid can be ejected by activation of ejection element 216. The difference between the compressive and tensile displacement durations, t1 and t2, can be seen in FIG. 10 which shows a corresponding example displacement pulse waveform that might be generated by the fluid actuator 206 with a compressive displacement duration of t1 and a tensile displacement duration of t2. The waveform of FIG. 10 indicates a displacement pulse/cycle on the order of 1 pico-liter (pl) with the compressive displacement duration, t1, of approximately 0.5 microseconds (ms) and the tensile displacement duration, t2, of approximately 9.5 ms. The values provided for the fluid displacement amount and displacement durations are only examples and not intended as limitations in any respect.

Figure 8A:
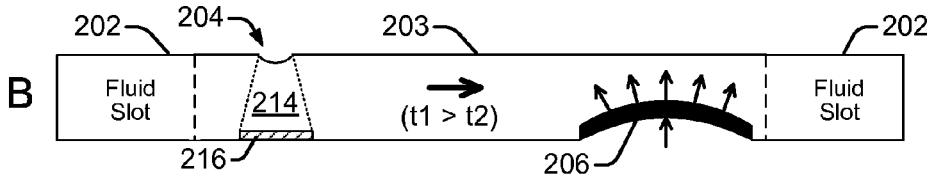
Figure 8B:
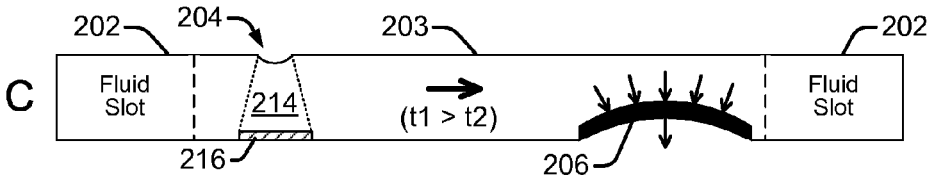

In FIGS. 8*a* and 8*b*, the compressive displacement duration, t1, is greater than the tensile displacement duration, t2, so there is a net fluid flow in the direction from the long side of the recirculation channel 203, through the drop generator 204, to the short side of the channel. Again, as fluid flows through the chamber 214 of drop generator 204, some fluid can be ejected by activation of ejection element 216. The difference between the compressive and tensile displacement durations, t1 and t2, can be seen in FIG. 11 which shows a corresponding example displacement pulse waveform that might be generated by the fluid actuator 206 with a compressive displacement duration of t1 and a tensile displacement duration of t2. The waveform of FIG. 11 indicates a displacement pulse/cycle on the order of 1 pico-liter (pl) with the compressive displacement duration, t1, of approximately 9.5 microseconds (ms) and the tensile displacement duration, t2, of approximately 0.5 ms.

Figure 9A:
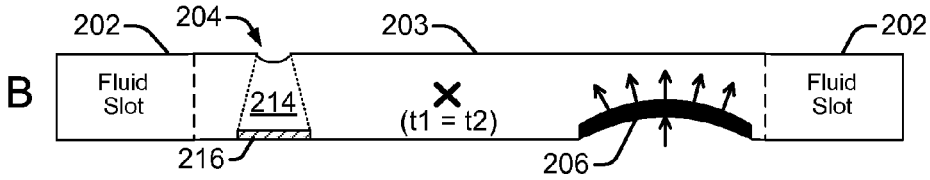
Figure 9B:
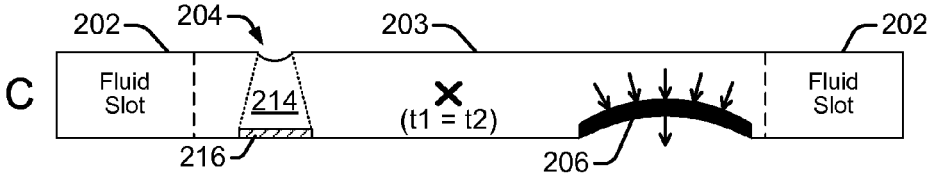

In FIGS. 9*a* and 9*b*, the compressive displacement duration, t1, is equal to the tensile displacement duration, t2, so there is little or no net fluid flow through the recirculation channel 203 or the drop generator 204 being generated by the fluid actuator 206. The equal compressive and tensile displacement durations of t1 and t2, can be seen in FIG. 12 which shows a corresponding example displacement pulse waveform that might be generated by the fluid actuator 206 with a compressive displacement duration of t1 and a tensile displacement duration of t2. The waveform of FIG. 12 indicates a displacement pulse/cycle on the order of 1 pico-liter (pl) with the compressive displacement duration, t1, of approximately 5.0 microseconds (ms) and the tensile displacement duration, t2, of approximately 5.0 ms.

Note that in FIGS. 9*a* and 9*b*, although there is asymmetric location of the fluid actuator 206 within the recirculation channel 203 (satisfying one condition for achieving the inertial pump effect), there is still little or no net fluid flow through the channel 203 or drop generator 204 because the fluid actuator 206 operation is not asymmetric (the second condition for achieving the pump effect is not satisfied). Likewise, if the location of the fluid actuator 206 was symmetric (i.e., located at the center of the channel 203), and the operation of the actuator 206 was asymmetric, there would still be little or no net fluid flow through the channel 203 because both of the pump effect conditions would not be satisfied.

From the above examples and discussion of FIGS. 5-12, it is significant to note the interaction between the pump effect condition of asymmetric location of the fluid actuator 206 and the pump effect condition of asymmetric operation of the fluid actuator 206. That is, if the asymmetric location and the asymmetric operation of the fluid actuator 206 work in the same direction, the fluid actuator 206 will demonstrate a high efficiency pumping effect. However, if the asymmetric location and the asymmetric operation of the fluid actuator 206 work against one another, the asymmetric operation of the fluid actuator 206 reverses the net flow vector caused by the asymmetric location of the fluid actuator, and the net flow is from the long side of the channel to the short side of the channel 203.

In addition, from the above examples and discussion of FIGS. 5-12, it can now be better appreciated that the fluid actuator 206 discussed above with respect to the recirculation channel 203 of FIGS. 2-4 is assumed to be an actuator device whose compressive displacement duration is less that its tensile displacement duration, since the net fluid flow proceeds from the short side of the channel 203 to the long side of the channel. An example of such an actuator is a resistive heating element that heats the fluid and causes displacement by an explosion of supercritical vapor. Such an event has an explosive asymmetry whose expansion phase (i.e., compressive displacement) is faster than its collapse phase (i.e., tensile compression). The asymmetry of this event cannot be controlled in the same manner as the asymmetry of deflection caused by a piezoelectric membrane actuator, for example.

Figure 13A:
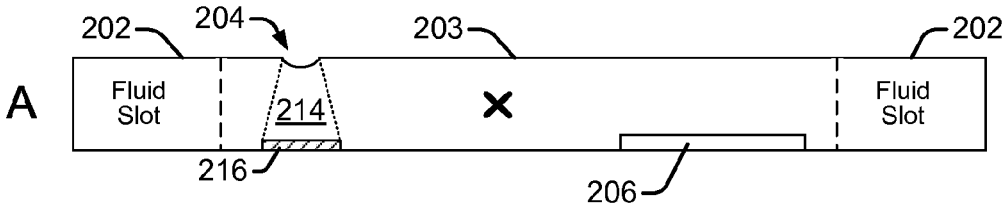
FIGS. 13*a*, 13*b* and 13*c* show side views of a recirculation channel with an integrated fluid actuator in different stages of operation, according to embodiments.
Figure 13B:
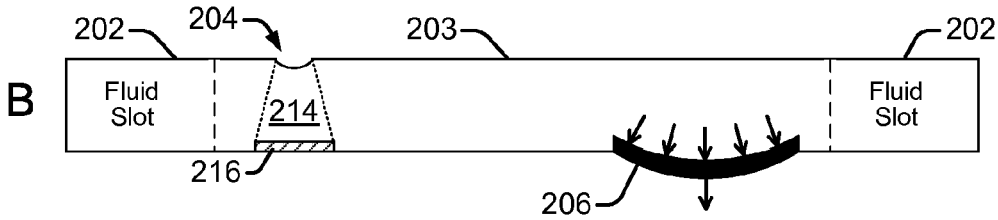
Figure 13C:
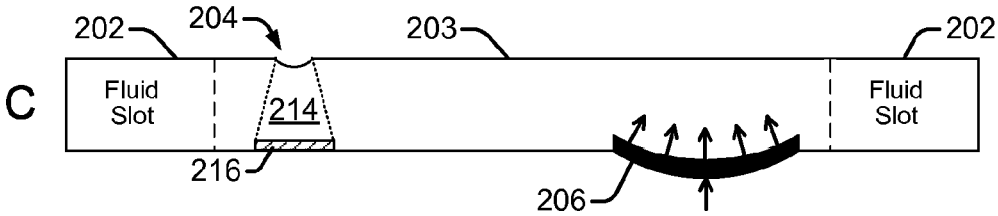

FIGS. 13*a*, 13*b* and 13*c* show a side view of a recirculation channel 203 with an integrated fluid actuator 206 in different stages of operation, according to embodiments of the disclosure. The recirculation channel 203 of FIG. 13 is the same as shown in FIG. 4, but is illustrated in a linear fashion to aid the description. This embodiment is similar to that shown and discussed above regarding FIG. 5, except that the deflections of the fluid actuator membrane are shown working differently to create compressive and tensile displacements within the channel 203. More specifically, in the FIG. 13 example, the tensile (negative) displacement occurs before the compressive (positive) displacement. In the previous examples referring to FIGS. 5-12, the compressive (positive) displacement occurs before the tensile (negative) displacement. At operating stage A, shown in FIG. 13*a*, the fluid actuator 206 is in a resting position and is passive, so there is no net fluid flow through the channel 203. At operating stage B, shown in FIG. 13*b*, the fluid actuator 206 is active and the membrane is deflected downward and outside of the fluidic channel 203. This downward deflection of the membrane causes a tensile displacement of fluid within the channel 203, as it pulls the fluid downward. At operating stage C, shown in FIG. 13*c* the fluid actuator 206 is active and the membrane is beginning to deflect upward to return to its original resting position. This upward deflection causes a compressive displacement of fluid within the channel 203, as the membrane pushes the fluid upward into the channel. A net fluid flow is generated through the channel 203 if there is temporal asymmetry between the compressive displacement and the tensile displacement. The direction of a net fluid flow is dependent upon the durations of the compressive and tensile displacements, in the same manner as discussed above.

Figure 14A:
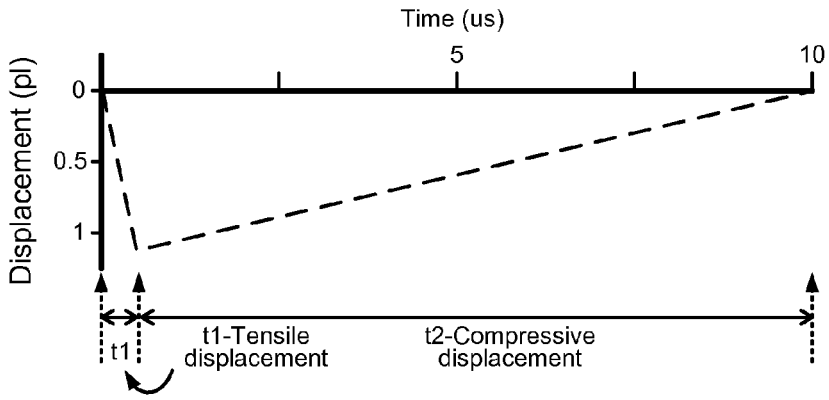
FIGS. 14*a*, 14*b* and 14*c* show example displacement pulse waveforms whose durations correspond with displacement durations of a fluid actuator, according to embodiments.
Figure 14B:
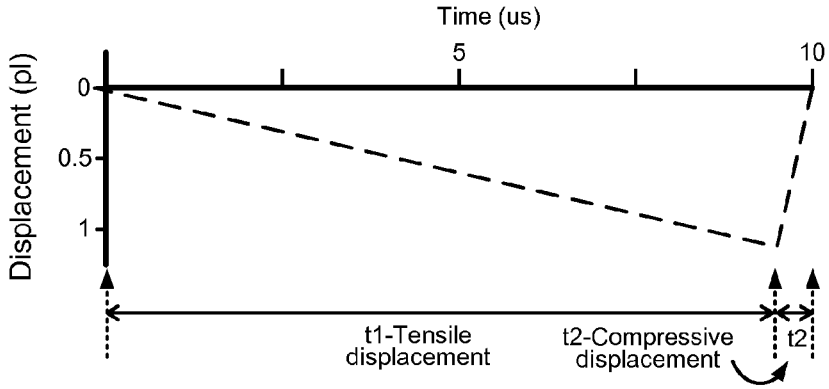
Figure 14C:
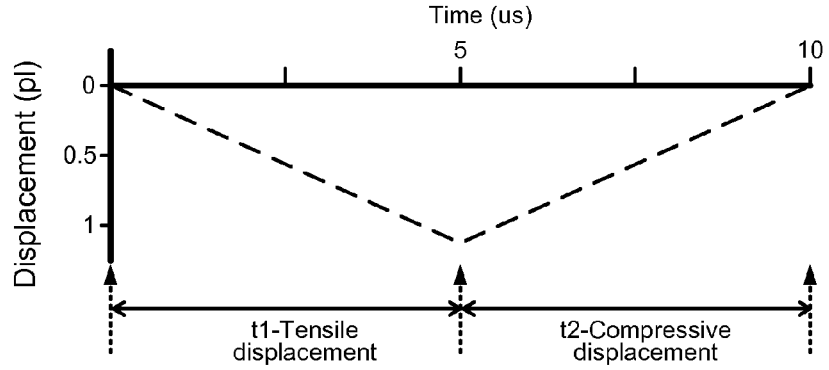

FIGS. 14*a*, 14*b* and 14*c* show example displacement pulse waveforms whose durations may correspond respectively with displacement durations t1 and t2 of FIGS. 13*b* and 13*c*, according to embodiments of the disclosure. The waveforms in FIG. 14 show the tensile (negative) displacement occurring before the compressive (positive) displacement. In both the previous examples, the fluid actuator 206 begins in a resting position and then either produces a compressive (positive) displacement followed by a tensile (negative) displacement, or it produces a tensile displacement followed by a compressive displacement. It is worth noting that various other displacement examples and corresponding waveforms are possible. For example, the fluid actuator 206 can be pre-loaded in a particular direction and/or it can traverse its resting position such that it deflects both into the channel 203 and out of the channel 203 as it produces compressive and tensile displacements.

Figure 15A:
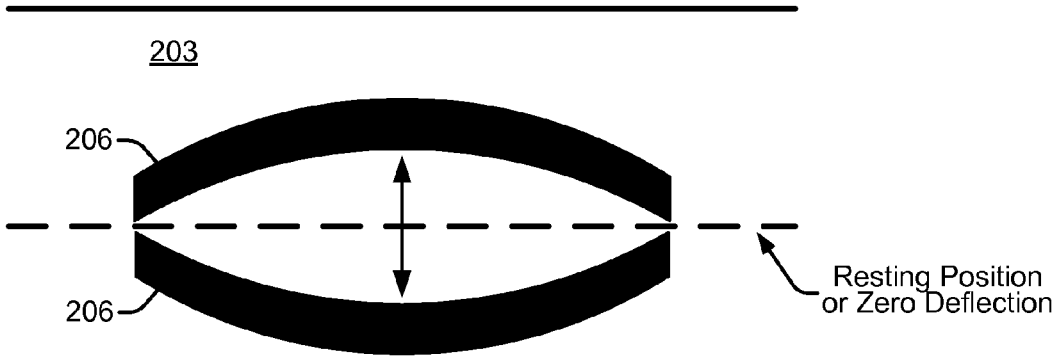
FIGS. 15*a*, 15*b* and 15*c* show an example representation of a fluid actuator deflecting both into and out of a channel, along with representative displacement pulse waveforms, according to an embodiment.
Figure 15B:
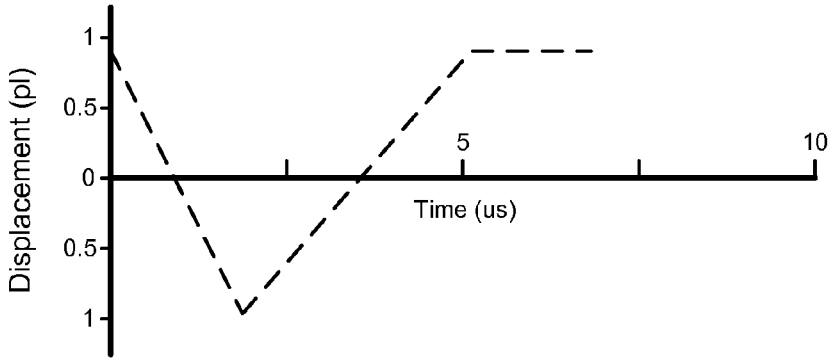
Figure 15C:
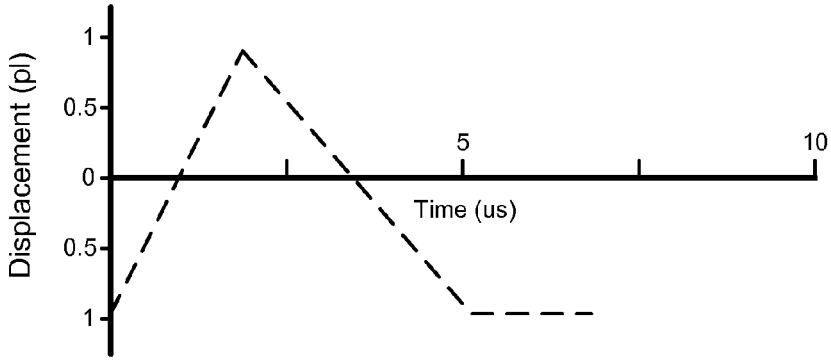

FIG. 15*a* shows an example representation of a fluid actuator 206 deflecting both into and out of a channel 203, along with representative displacement pulse waveforms shown in FIGS. 15*b* and 15*c* to illustrate both how the actuator 206 can deflect into the channel 203 and out of the channel 203 as it produces compressive and tensile displacements and the possible pre-loading of the actuator 206 in a positive or negative deflection. Such deflections of the actuator 206 into and out of channel 203 and pre-loading of the actuator 206 are controlled, for example, by flow control module 126 executing on electronic controller 110.

What is claimed is:

1. A fluid ejection device comprising:

a fluid recirculation channel including an inlet channel, an outlet channel, and a connection channel between the inlet channel and the outlet channel;

a drop generator disposed within one of the inlet channel and the outlet channel of the recirculation channel;

a fluid slot in fluid communication with each of the inlet channel and the outlet channel of the recirculation channel; and a piezoelectric fluid actuator disposed within the other of the inlet channel and the outlet channel of the recirculation channel and located asymmetrically within the recirculation channel to cause fluid flow from the fluid slot, through the recirculation channel and drop generator, and back to the fluid slot.

2. A fluid ejection device as in claim 1, further comprising a controller to control the direction of the fluid flow by causing the piezoelectric fluid actuator to generate compressive and tensile fluid displacements of controlled duration.

3. A fluid ejection device as in claim 2, wherein the duration of the compressive and tensile fluid displacements is unequal.

4. A fluid ejection device as in claim 2, further comprising a flow control module executable on the controller to control the duration of the compressive and tensile fluid displacements.

5. A fluid ejection device as in claim 1, further comprising non-moving part valves in the recirculation channel to promote fluid flow in one direction.

6. A fluid ejection device as in claim 1, wherein the drop generator is located in the outlet channel and the actuator is located in the inlet channel.

7. A fluid ejection device as in claim 1, wherein the drop generator is located in the inlet channel and the actuator is located in the outlet channel.

8. A fluid ejection device as in claim 1, wherein the inlet channel and the outlet channel are oriented substantially parallel with each other.

9. A fluid ejection device as in claim 1, wherein the connection channel is oriented substantially perpendicular to the inlet channel and the outlet channel.

10. A fluid ejection device as in claim 1, wherein the inlet channel and the outlet channel are oriented substantially perpendicular to a longitudinal axis of the fluid slot, and the connection channel is oriented substantially parallel with the longitudinal axis of the fluid slot.

11. A fluid ejection device as in claim 1, wherein the fluid actuator is to be operated asymmetrically to cause the fluid flow from the fluid slot, through the recirculation channel and drop generator, and back to the fluid slot.

12. A fluid ejection device comprising:

a drop ejector in one of an inlet channel and an outlet channel of a fluid recirculation channel;

a fluid control system to control the direction, rate and timing, of fluid flow through the recirculation channel and drop ejector;

wherein the fluid control system comprises a fluid actuator in the other of the inlet channel and the outlet channel of the recirculation channel, and a controller with executable instructions to cause the fluid actuator to generate temporally asymmetric compressive and tensile fluid displacements within the recirculation channel that drive the fluid flow.

13. A fluid ejection device as in claim 12, wherein the recirculation channel includes a connection channel between the inlet channel and the outlet channel.

14. A fluid ejection device as in claim 13, wherein the fluid control system is to control the direction, rate and timing, of the fluid flow from a fluid slot, through the inlet channel, the connection channel, and the outlet channel, and back to the fluid slot.

15. A fluid ejection device as in claim 14, wherein the inlet channel and the outlet channel are oriented substantially perpendicular to a longitudinal axis of the fluid slot.

16. A fluid ejection device as in claim 14, wherein the connection channel is oriented substantially parallel with a longitudinal axis of the fluid slot.

17. A fluid ejection device as in claim 12, wherein the inlet channel and the outlet channel of the recirculation channel are oriented substantially parallel with each other.

18. A fluid ejection device as in claim 12, wherein the fluid actuator is integrated asymmetrically within the recirculation channel.

* * * * *